US007004657B2

(12) United States Patent
Frazier

(10) Patent No.: US 7,004,657 B2
(45) Date of Patent: Feb. 28, 2006

(54) SINGLE USE APPLICATOR FOR APPLYING VISCOUS FLUIDS

(76) Inventor: Thomas G. Frazier, 17 Welden Dr., Doylestown, PA (US) 18901

( * ) Notice: Subject to any disclaimer, the term of this patent is extended or adjusted under 35 U.S.C. 154(b) by 0 days.

(21) Appl. No.: 10/788,690

(22) Filed: Mar. 1, 2004

(65) Prior Publication Data

US 2005/0191113 A1 Sep. 1, 2005

(51) Int. Cl.
*B45K 5/14* (2006.01)

(52) U.S. Cl. ..... 401/133

(58) Field of Classification Search ..... 401/132–135, 401/198, 199; 604/3; 222/541, 80
See application file for complete search history.

(56) References Cited

U.S. PATENT DOCUMENTS 1,146,522 A * 7/1915 Schulz ..... 604/3
1,229,195 A * 6/1917 Hamilton ..... 604/3
1,293,401 A * 2/1919 Gibson ..... 604/3
3,393,962 A * 7/1968 Andrews ..... 401/132
4,572,689 A * 2/1986 Chernack ..... 401/132
4,732,287 A * 3/1988 Bennett ..... 215/49
4,957,385 A * 9/1990 Weinstein ..... 401/132
5,098,297 A * 3/1992 Chari et al. ..... 433/215
5,548,016 A * 8/1996 Provenzola ..... 524/507
5,899,622 A * 5/1999 Gueret ..... 401/122
6,056,737 A * 5/2000 Rosen ..... 401/132
6,254,297 B1 * 7/2001 Frazier ..... 401/133

* cited by examiner

*Primary Examiner*—Justine R. Yu
*Assistant Examiner*—Huyen Le
(74) *Attorney, Agent, or Firm*—Zachary T. Wobensmith, III

(57) ABSTRACT

A single use applicator for dispensing and applying a thin layer of viscous fluid, comprising an outer body of chemically inert deformable material open at one end, a crushable glass ampoule therein containing fluid to be dispensed and applied, and an application element of synthetic fiber strands in said tube, wherein fluids flows by capillary action, with an internal reservoir inside the tube adjacent the ampoule, a fluid control valve welded to the tube at its approximate mid point, to control fluid flow, and an external tip to apply the fluid to an application surface.

12 Claims, 4 Drawing Sheets

SINGLE USE APPLICATOR FOR APPLYING VISCOUS FLUIDS

BACKGROUND OF THE INVENTION

1. Field of the Invention

This invention relates to a single use applicator for applying viscous fluids having viscosities greater than water, and is of the type which includes fluid carried in a hermetically sealed crushable glass ampoule, with an anhydrous inert gas head, which ampoule is contained in a chemically inert deformable tube, with an application element comprised of a plurality of synthetic fiber strands bonded thereto. The application element has a centrally located restrictive valve section to control fluid flow, with an internal fluid reservoir section adjacent the ampoule, and an external tip section to apply the fluid.

2. Description of the Prior Art

Applicators for dispensing fluids for various uses, and which are of the single use type are well known in the art. Such applicators take many forms, but the most common device is one that contains a thin walled glass ampoule that contains fluid, which ampoule is inside a cardboard or plastic tube which is closed at one end and sealed at the other end with a porous application tip. Various techniques are used to release the fluid from the ampoule, including crushing the tube with the thumb and forefinger, a slide ring activator to crush the ampoule as described in the Frazier U.S. Pat. No. 5,509,744, or using an external lever or an integral plunger to the tube, as described in the Koreska U.S Pat. No. 4,784,506. Most of the prior art patents deal with fluids of relatively low viscosity (i.e. equal to or less than water or that are generally described as "ideal fluids") that readily flow in the tube to the fibrous applicator tip and saturate the tip. The applicator tip in these devices is generally designed so that it can totally hold, or absorb the fluid contained in the ampoule, so that dripping is not a concern. This design technique, however, allows a significant quantity of the dispersed fluid to remain in the tip after use, thereby reducing the efficiency of the device and also limiting the amount of fluid to be dispensed.

When attempting to fill the prior art devices described above with fluids with higher viscosities than water, and in quantities greater than the saturation capacity of the absorbent tip, the flow rate of the fluid to the application tip is considerably longer in time than efficiency will allow for convenient and effective use. Additionally, when these prior art applicator devices with an application tip saturated with the application fluid are held in the downward position, the unabsorbed fluid above the saturated porous application tip creates hydrostatic head pressure, which is directly proportional to the fluid height above the tip, and will cause the applicator to drip fluid from the tip at first and then slow down as the hydrostatic head is reduced, thereby creating a non uniform fluid application.

Non-uniform fluid application is particularly abhorrent when applying adhesion promotion primers to metal, glass or other hard surfaces. Applying too much primer is worse than no primer at all, as a very uniform and thin layer of primer is always desired.

In the prior art Andrews U.S. Pat. No. 3,393,962 fluid flow to the application tip is prevented unless the user squeezes the device. A series of chambers and communication tubes is used to achieve this result. In addition, the '962 device requires the use of a pre-filter, making the device costly to assemble. Proper use of the device relies heavily on the user's ability to squeeze just the right quantity of fluid to the brush tip through finger pressure on the tube. Too great a squeeze pressure will cause the applicator brush to drip, or cause too much, or varying amounts of fluid to be applied to the surface. Using the Andrews device in an inverted upward position to apply a uniform application, is particularly difficult, if not impossible, as a constantly increasing finger tip pressure would be required to apply a uniform band of the application fluid.

Robert in U.S. Pat. No. 1,146,522 tried to solve the problem of reducing the time to saturate the tip by encapsulating the brush tip within the liquid filled ampoule. Depending on how the device was stored prior to activating (i.e. tip up or tip down), non uniform results are obtained as the tip is very likely to drip if stored with tip down, and if stored with the tip up prior to activating, the fibrous tip is likely to be dry of most fluid, and the user would be back to the long time frame required for the tip to "wet out". Since the body housing the '522 device is not deformable (because it is glass) reducing the "wet out" time of the brush tip by squeezing the body housing is not possible. Finally this device exposes the ampoule to accidental breakage prior to use since it is housed in an unprotected glass body.

Krawczyk in U.S. Pat. No. 6,039,488 does not deal with the issues presented by dispensing and applying "non-ideal" fluids with viscosities higher than water, or with the fluid content of the encapsulating ampoule being in excess of the saturation level of the application tip, (or holding capacity) of its porous plug construction. For a device to effectively deal with the above conditions, the applicator must have an internal valve feature, ideally located at the approximate mid-point of its porous element, and having a narrowing cross section of the deformable tube. My device uses a three sectioned porous element. One, a middle or valve section of higher porous density than either of the two ends. The density of this valve section is chosen to give the desired flow rate of the specific application fluid to be used. The internal end section of the porous element, which has a substantially lower density than the valve section, acts as a fluid reservoir that is in immediate and adjacent contact with the valve section of the porous element. The external end section of the porous element also has an equally lower porous density and acts as a soft, compliant applicator tip.

The '488 patent only provides a "porous plug" with or without "small passage ways" that necessarily would have a uniform linear density along the porous plug length. To attempt to apply fluids in excess of the saturation level of the porous plug, would, from time to time, necessarily allow too much, or too little fluid to be applied to the surface to be primed, as the hydrostatic pressure head above the porous plug would vary as the fluid level changes, as it is being dispensed. Assuming the porous plug's density was chosen to allow the desired flow rate to the outer end of the applicator, any fluid in excess of the saturation level of the plug that is above the plug would create a varying hydrostatic fluid head pressure. This condition, at the beginning of use, would cause excessive flow to the tip (and perhaps cause dripping). Proper flow would only be restored after this excess fluid was dispensed. This same situation would occur when dispensing fluids with viscosities greater than water, when the applicator was in a vertically downward position. However, when used in an inverted upward position, the flow rates would fall off dramatically since the porous plug would be starved for a continued flow of fluid as the '488 structure makes no provision for an internal and adjacent reservoir section (with lower porous density) as part of the porous plug. Moreover, the user would have to squeeze the applicator to increase flow, and excessive fluid laydown could result. If used in the tip down configuration, there is no way to slow down the fluid flow once the uniform density of the tip is chosen for the design. If the density of the tip is chosen so as to allow a certain flow rate while there is a hydrostatic head pressure over the tip (i.e. at the start of use of the device), the flow will necessarily be inadequate when this hydrostatic head is reduced or absent. To increase the flow in the '488 device would require the unreliable technique of squeezing the tube to restore fluid flow.

The device described in the Fisher U.S. Pat. No. 5,746,019 is subject to the same limitations as the Krawczyk device. Wirt in U.S. Pat. No. 5,288,159 does not allow use of 'non-ideal' fluids (i.e. fluids with viscosities greater than water) since there is no way to speed up "wet out" times. The '159 device has an air vent in the top, so that squeezing the tube to increase the internal pressure above the fluid, even if possible, would not force the viscous fluid through the applicator pad. Additionally, since there is not internal fibrous reservoir next to the applicator pad, to "feed" fluid via capillary action, the device cannot be used effectively for inverted and upward operational positions.

Schwartzman in U.S. Pat. No. 3,614,245 does not deal with applying larger quantities of viscose application fluid in excess of the saturation capacity of the surrounding porous material. Fluid is dispersed in all directions making the device inefficient, as a large portion of the application fluid will remain in the device as absorbed fluid, and undeliverable to the open end of the applicator. In the case of very expensive viscous fluids, to overcome this characteristic of the '245 device would require filling the ampoule with excessive fluid, causing the device's cost to be uneconomical.

The single use applicator of the invention allows viscous fluids to be applied with a thin uniform application of the fluid to the application surface, and does not suffer from the prior art problems.

SUMMARY OF THE INVENTION

It has now been found that a single use applicator for dispensing viscous fluids is available, which includes an outer deformable chemically inert cylindrically shaped tube, with an open end and a closed end with the open end tapering to form a venturi shape, a crushable glass ampoule is provided inside the tube, which ampoule holds the fluid to be dispensed, a porous element is retained in the open end, which includes an internal end section adjacent the ampoule to act as a fluid reservoir, a compressed mid section to provide a valve action for controlled flow, and an external end section to apply a uniform layer of fluid on the application surface.

The principal object of the invention is to provide a single use applicator that can dispense and uniformly apply a band of viscous fluid to an application surface.

A further object of the invention is to provide a single use applicator that can dispense and apply a band of viscous fluid that contains suspended solids to an application surface.

A further object of the invention is to provide a single use applicator that has a long shelf life.

A further object of the invention is to provide a single use applicator that permits as much as 90% of the applicator fluid capacity to be dispensed and applied.

A further object of the invention is to provide a single use applicator that provides a fast and easy technique to "wet out" its application tip.

A further object of the invention is to provide a single use applicator that can be used in the vertical downward, horizontal and inverted upward positions, and which provides a uniform fluid flow to the tip in all positions.

A further object of the invention is to provide a single use applicator that provides for the optimal applicational use of expensive and environmentally dangerous fluids, by limiting the VOC's to the minimum, while providing use up rates up to 90% of the fluid stored in the applicator ampoule A further object of the invention is to provide a single use applicator that includes an airtight cap to allow multiple uses of the fluid contained in the applicator ampoule, within an extended time frame allowed from initial applicator activation time.

A further object of the invention is to provide a single use applicator that can dispense and apply a band of viscous fluid onto a variety of application surfaces.

A further object of the invention is to provide a single use applicator whose applicator tip can be configured to fit specific application requirements.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
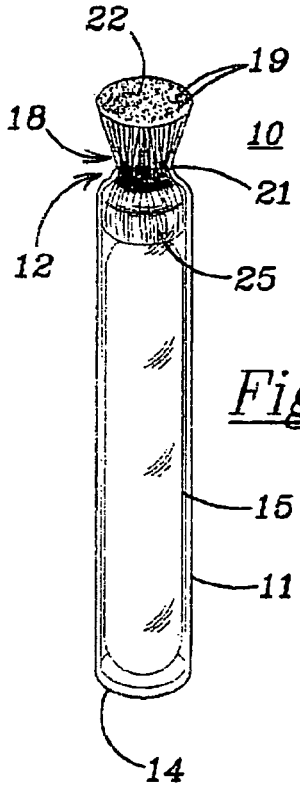
FIG. 1 is a perspective view of an assembled applicator device of a preferred embodiment of the invention.

It should of course be understood that the description and drawing described herein are merely illustrative, and that various modifications and changes can be made in the structures disclosed without departing from the spirit of the invention.

Like numerals refer to like parts through the several views.

DESCRIPTION OF THE PREFERRED EMBODIMENTS

When referring to the preferred embodiments, certain terminology will be utilized for the sake of clarity. Use of such terminology is intended to encompass not only the described embodiments, but also technical equivalents, which operate and function in substantially the same way to bring about the same result.

Referring now to more particularly to the drawings and FIG. 1–6B thereof an embodiment of the single use applicator device 10 is therein illustrated.

The device 10 includes an outer cylindrical tube body 11, which is open at one end 12, with a rim tapering section 13, and which is closed at its other end 14.

The tube 11 is preferably constructed of a chemically inert thermoplastic resin of well known type such as polyethylene resin. The body 11 is capable of being readily deformed by finger pressure of the user, and returns to its original shape upon pressure release. The resin material comprising the tube 11 is also capable of being compressed and welded by a variety of methods, including ultrasonic, microware, and thermal.

A cylindrically shaped ampoule 15 is provided, preferably constructed of glass of well known type such as onion skinned glass, which is chemically inert to the application fluid 16 contained therein. The fluid 16 can be any desired viscous fluid with or without suspended solids, such as adhesion promoting primers containing isocynates, and which may contain carbon black suspended solids. Such fluids are often referred to as "non ideal fluids".

The ampoule 15 is hermetically sealed at both ends, preferably with an anhydrous inert gas head (not shown) over the fluid 16.

The ampoule 15 as shown in the FIGS is carried entirely within the tube 11.

Figure 2A:
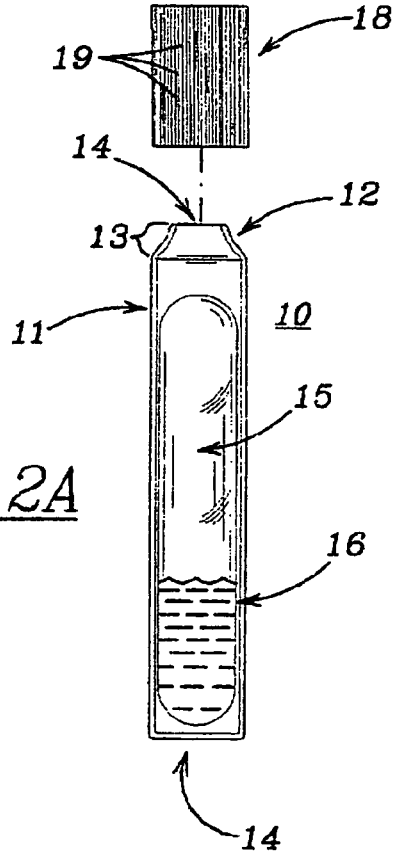
FIG. 2A is a perspective view of an unassembled applicator device of a preferred embodiment of the invention.
Figure 2B:
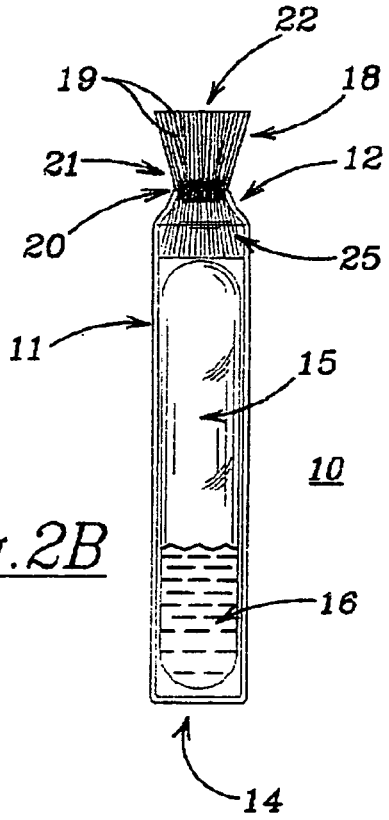
FIG. 2B is a side elevational view of the assembled applicator device of the invention.

An applicator element 18 is provided constructed of a plurality of fiber strands 19, in side by side relation, and as shown in FIG. 2A initially forming a porous cylindrical structure. The fibers 19 are of any suitable synthetic material, such as polyester fiber, compatible with the fluid 16 to be carried and dispensed from the device.

The element 18 is inserted into the open end 14 of the tube 11, and past the rim section 13 to approximately the midpoint 20 of element 18. The tube 11 is tapered at the rim section 13 and mid point 20, preferably by heat and pressure, and welded thereto. The element 18 is compressed at its mid point 20 within a range of 0.5 to 0.8 times its original diameter to provide a valve section 21, whose flow rate is predetermined to provide the desired capillary action to provide fluid flow to an application tip section 22 of element 18. The tube 11 when tapered at its rim section 13 causes the element 18 to form an "hour glass" shape.

The fiber strands 19 due to compression and welding are partially connected to adjacent strands to allow for the desired capillary action.

If desired the element 18 may be preformed by compressing and welding it at its midpoint 20, prior to insertion into open end 14 of tube 11, and subsequent compression and welding of tube 11 at rim section 13 to join it to element 18.

The element 18, includes three distinct sections of varying fluid density, i.e., a compressed mid point 20 with a Venturi like cross section shape, (the valve section) having a porous density designed to allow fluid flow via capillary action only of a desired rate, to produce a thin and uniform application film on the application surface, an internal reservoir 25, and an external application tip 22.

The internal reservoir 25 inside of tube 11 is adjacent the ampoule 15, with a selected density to absorb and hold fluid to be dispensed, to be described. The external tip 22 is of lower porous density than the valve 21, thereby allowing this exposed portion to be soft and compliant in nature, to allow the tip 22 to conform to varying application surfaces, both flat and irregular in nature, and to dispense a uniform layer of fluid. The internal fluid reservoir 25 is also of lower porous density than the valve 21, which allows it to act as an internal fluid reservoir for the application fluid, and which is in intimate and adjacent position to ampoule 15, and to the valve 21 of element 18 prior to activation.

Figure 6A:
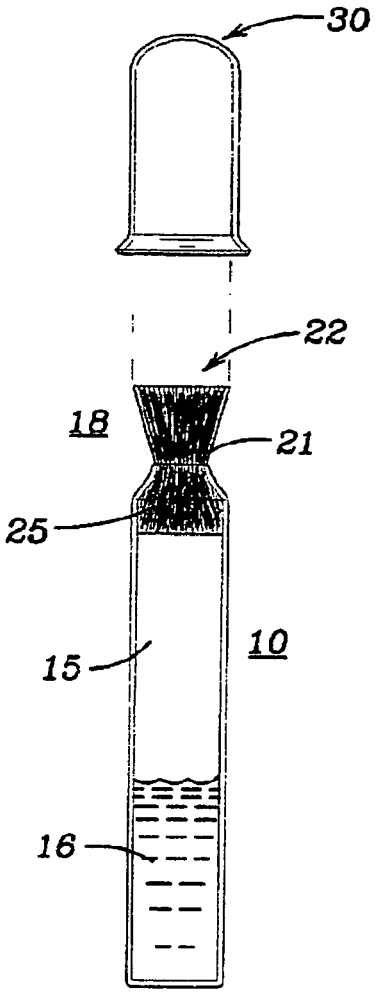
FIG. 6A is a side elevational view of the applicator device of the invention with an end cap, which is off of the device.
Figure 6B:
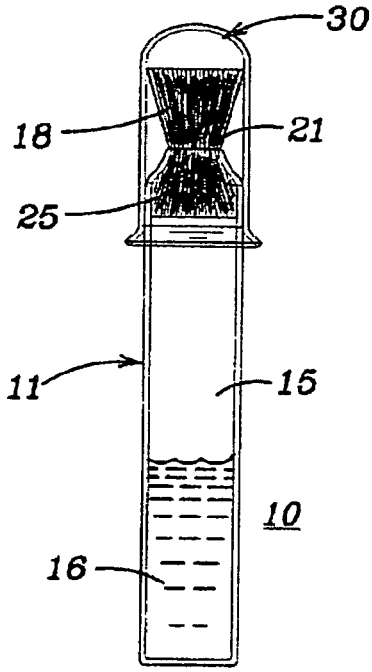
FIG. 6B is a view similar to FIG. 6A with the end cap in closure position on the device.

Referring now to FIGS. 6A and 6B the applicator device as described above includes a cap 30 which is open at one end, and which may be placed over the tip 22 to seal it from the air.

Figure 7:
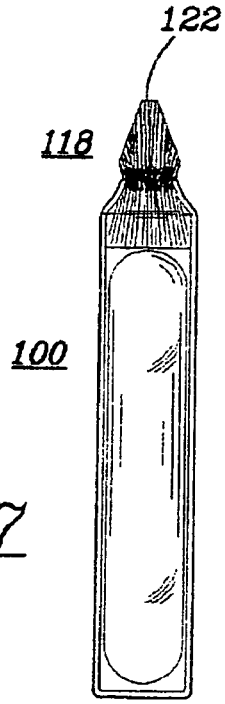
FIG. 7 is a side elevational view of the applicator device of the invention with a modified applicator tip.

Referring now to FIG. 7 another embodiment of single use applicator 100 is therein illustrated which is similar to applicator 10 described above. The applicator 100 has an applicator tip 122 of element 118, which has been trimmed to provide a "chisel tip" shape, which may be desired for certain applications.

Figure 5A:
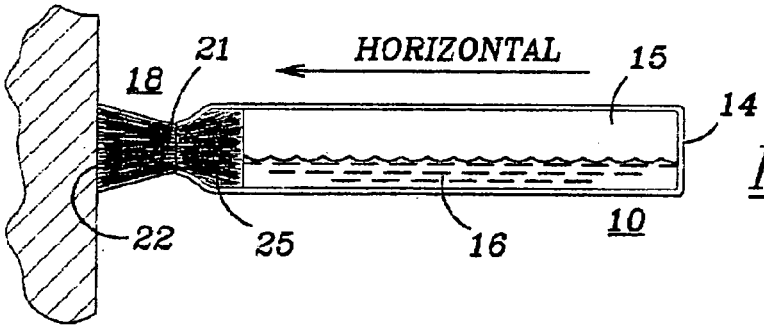
FIG. 5A is a side elevational view of the applicator device of the invention in use in the horizontal position.
Figure 5B:
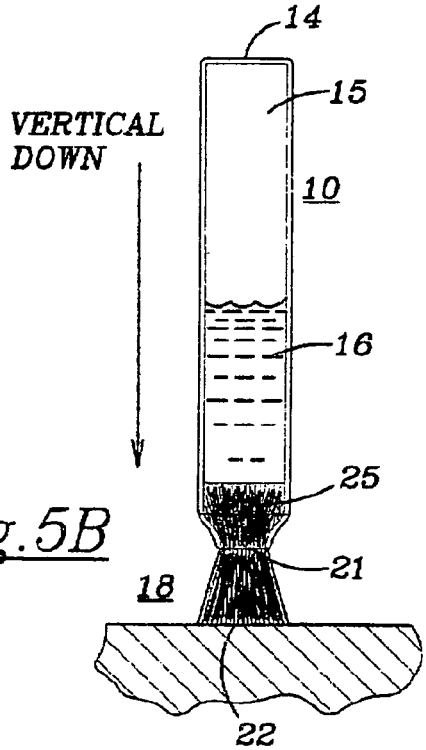
FIG. 5B is a side elevational view of the applicator device of the invention in use in the vertical downward position.
Figure 5C:
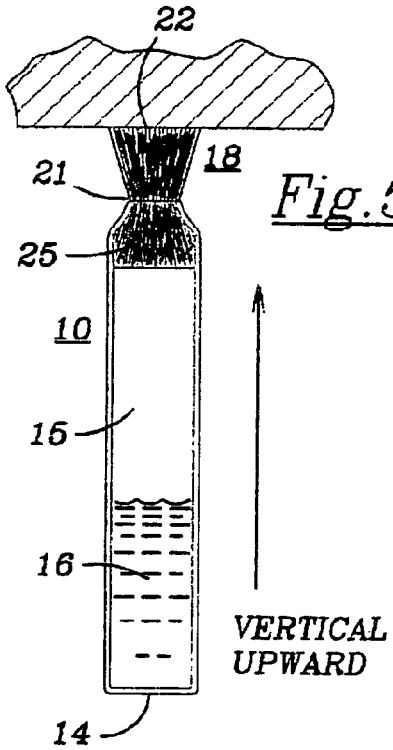
FIG. 5C is a side elevational view of the applicator device of the invention in use in the vertical upwardly extending position.

The single use applicator 10 or 100 may be used in various positions, including horizontally as shown in FIG. 5A, vertically downwardly as shown in FIG. 5B, and vertically upwardly as shown in FIG. 5C.

Figure 3A:
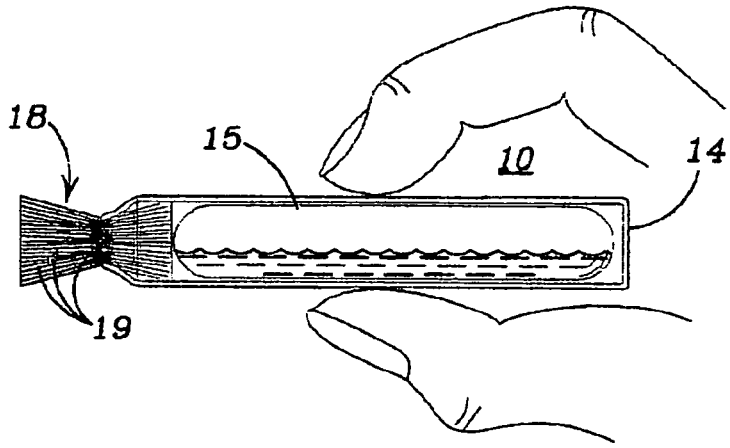
FIG. 3A is a side elevational view of the applicator device, showing the device in a horizontal position prior to being activated.
Figure 3B:
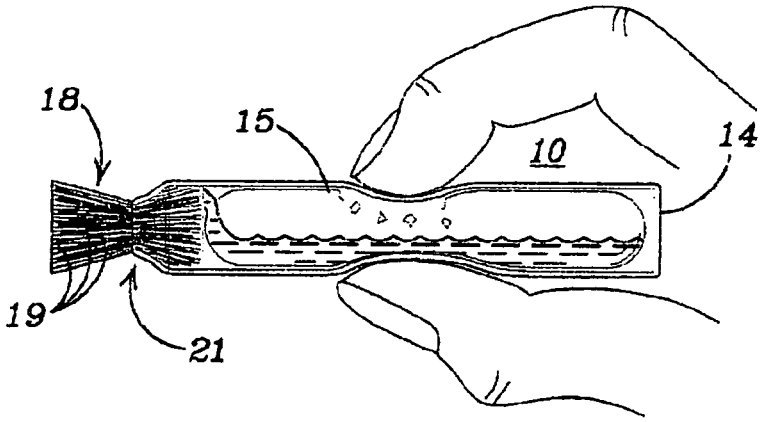
FIG. 3B is a view similar to FIG. 3A showing the device being activated by squeezing the ampoule between the thumb and forefinger of the user to crush the applicator ampoule and release the fluid for application.
Figure 3C:
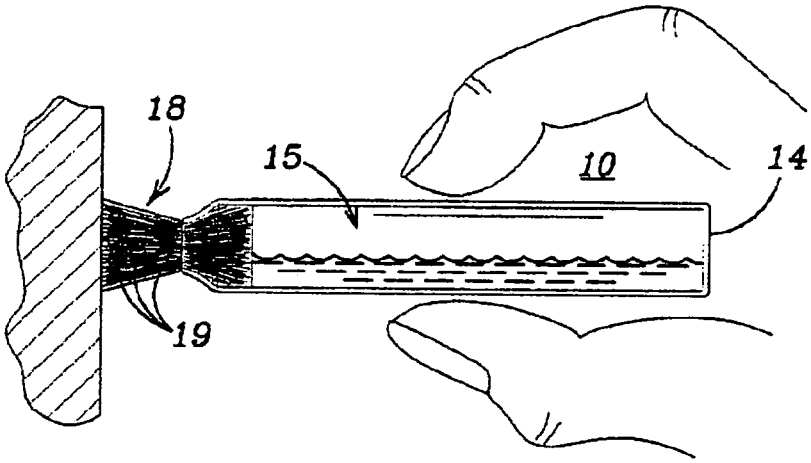
FIG. 3C is a view similar to FIG. 3A illustrating the applicator device, after being activated and after the tube has returned to its original shape.
Figure 4:
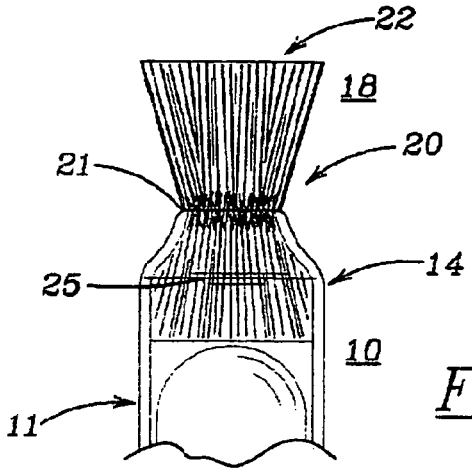
FIG. 4 is a fragmentary view of the "control valve" feature of the applicator of the invention.

In the inverted upright position of FIG. 5C and the horizontal position of FIG. 5A, the element 18 is first "wetted out" entirely with the application fluid 16, by activating the device 10, which can be shaken to mix the application fluid 16 if desired, and then by squeezing the deformable tube 11 between the user's thumb and forefinger as shown in FIGS. 3A, and 3B to crush ampoule 15 and release fluid 16. The air pressure within the tube 11 is increased by the reduced internal volume condition, causing the fluid 16 to be forced through the element 18. This procedural step assures both fast tip "wet-out" times and fully loading the internal reservoir 25, as well as the tip 22 of the element 18 with the application fluid 16.

When the activated device 10 is held in either a horizontal position or inverted upright position, there is no, or essentially no hydrostatic head pressure at the application tip 22. The flow rate is entirely controlled by the capillary action of the pre-designed density of the valve 21 of the element 18, with the internal reservoir 25 supplying the application fluid 18 to the valve 21, and then to the external application tip 22 of the element 18 via capillary action only. Thus, in either of these two positions, the desired flow rate is achieved and maintained.

In the vertically downward position as shown in FIG. 5B the application fluid 16, is in excess to the holding or saturation capacity of the element 18.

This condition creates hydrostatic head pressure over the element 18.

Because of Bernoulli law of fluid dynamics, an ideal fluid flowing through a restricted portion of a pipe like container, causes the fluid flow to "accelerate (in comparison to its flow rate before the restriction) for a short distance in the restricted area because the product of fluid velocity by cross sectional area must remain constant."

In the case of non-ideal fluids, it is necessary to balance the size of the tube restriction (Venturi type) at valve 21 with the specific viscosity of the application fluid 16 to achieve uniform fluid flow without further squeezing of the tube 11. The restriction, as per Bernouli's law, at first increases the velocity of flow to the rate that would be achieved by "ideal" fluids, but the "non-ideal" fluid creates tangential forces (i.e.

frictional forces), parallel to flow that tend to counteract the increase in flow. These frictional forces are greater than those produced by less viscous or "ideal" fluids. When the Venturi section is properly designed for a particular "non-ideal" fluid, these increased friction forces can be made to reduce and balance the effect of increasing flow through the Venturi section of the element 18, resulting in a consistent flow rate to the external tip.

' Elements of Phusics, 2nd Edition Shortley, Williams. Page 147

The higher the fluid level above the element 18, the faster the fluid velocity through the Venturi section valve 21, and hence the greater the tangential forces (frictional forces). Thus the flow rate out of the Venturi is somewhat slowed as compared to those achieved with ideal fluids. As the hydrostatic head pressure is reduced during the device's use, the flow rate through the Venturi section is reduced at a proportional rate to the changing fluid height above the porous section. The resulting frictional forces produced are also so reduced by a proportional linear amount. The resulting flow rate to the exposed application tip 22 is, by design, required to remain constant, regardless of the fluid height of the fluid 16 above the element 18.

This above unique construction provides a single use applicator that meets the objects of the invention.

What is claimed is:

1. A single use applicator for dispensing and applying a continuously uniform band of viscous fluid to a surface, without using further manual operator pressure, or intervention, after initial activation, to dispense the fluid to the surface, which comprises;

an outer chemically inert cylindrical deformable tube, closed at one end, and open at the other;

said open end having a tapering rim section thereon, a hermetically sealed crushable glass ampoule carried in said tube, a viscous fluid in said ampoule to be dispensed, a multi section applicator element means in said tube open end, comprised of a plurality of synthetic fiber strands in side by side relationship, said applicator element means is compressed at its mid longitudinal point, providing a control valve section of predetermined porous density, and forming an hour glass configuration, said applicator element means having an internal fluid reservoir section of lower porous density than said control valve section, adjacent to said control valve section and to said ampoule, said applicator element means has an external fluid applicator tip of lower porous density than said control valve section , which is adjacent to said valve section, and said tube is compressed at its rim section and engaged with said applicator element control valve section, retaining it therein.

2. A single use applicator, as defined in claim 1 in which said fluid control valve has a minimum diameter at its approximate midpoint of 0.5 to 0.8 times the diameter of said element at its uncompressed ends.

3. A single use applicator as defined in claim 1 in which said viscous fluid has suspended solids therein.

4. A single use applicator, as defined in claim 1 in which said tube is of polyethylene resin.

5. A single use applicator as defined in claim 1 in which said tube is of onion skin glass.

6. A single use applicator as defined in claim 1 in which said ampoule has an inert anhydrous gas head over the fluid therein.

7. A single use applicator as defined in claim 1 in which said applicator is provided with a mating cap to seal an activated applicator tip from the air.

8. A single use applicator as defined in claim 1 in which said applicator fluid is an isocynate based primer with suspended carbon black solids.

9. A single use applicator as defined in claim 1 in which said tube rim section is formed by sonically welding said applicator element to said tube at the same time.

10. A single use applicator as defined in claim 1 in which said tube rim section is welded to said applicator element by heat and pressure.

11. A single use applicator, as defined in claim 1 with a tubular body portion of sufficient strength and wall thickness to protect the said enclosed ampoule from accidental breakage during shipment and handling prior to use.

12. The single use applicator as defined in claim 1 in which said applicator element is constructed of polyester fiber tow bonded along its axial length.

* * * * *